US012685416B2

(12) United States Patent
Kowalski et al.

(10) Patent No.: US 12,685,416 B2
(45) Date of Patent: Jul. 21, 2026

(54) SURFACE CLEANER

(71) Applicant: Techtronic Cordless GP, Anderson, SC (US)

(72) Inventors: Gregory Kowalski, Cornelius, NC (US); John Morphey, Concord, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 318 days.

(21) Appl. No.: 18/602,877

(22) Filed: Mar. 12, 2024

(65) Prior Publication Data

US 2024/0324831 A1 Oct. 3, 2024

Related U.S. Application Data

(60) Provisional application No. 63/492,419, filed on Mar. 27, 2023.

(51) Int. Cl.

| | |
|---|---|
| ***A47L 9/04*** | (2006.01) |
| ***A46B 13/00*** | (2006.01) |
| ***A46B 13/02*** | (2006.01) |
| ***A47L 9/06*** | (2006.01) |

(52) U.S. Cl.

CPC ..... *A47L 9/0606* (2013.01); *A46B 13/001* (2013.01); *A46B 13/02* (2013.01); *A47L 9/0444* (2013.01); *A47L 9/0477* (2013.01); *A46B 2200/3033* (2013.01)

(58) Field of Classification Search

CPC . A47L 9/04; A47L 9/06; A47L 9/0606; A46B 13/02

See application file for complete search history.

(56) References Cited

U.S. PATENT DOCUMENTS

| | | | |
|---|---|---|---|
| 6,101,669 | A | 8/2000 | Martin et al. |
| 6,314,610 | B1 | 11/2001 | Miller et al. |
| 7,036,825 | B2 | 5/2006 | Pettitt et al. |
| 7,152,274 | B2 | 12/2006 | Alford et al. |
| 7,862,637 | B2 | 1/2011 | Han et al. |
| 8,349,428 | B2 | 1/2013 | Conrad |
| 8,572,800 | B2 | 11/2013 | Haan |

(Continued)

FOREIGN PATENT DOCUMENTS

| | | |
|---|---|---|
| CA | 2731649 A1 | 3/2009 |
| CN | 101657134 B | 5/2013 |

(Continued)

*Primary Examiner* — Michael D Jennings

(74) *Attorney, Agent, or Firm* — Michael Best & Friedrich LLP

(57) ABSTRACT

A surface cleaner includes a base including a suction inlet in fluid communication with a debris separator and a suction source. The base includes a housing having a channel extending around at least a portion of the suction inlet, the channel having a first sidewall offset from a second sidewall. The base further includes a soleplate configured to slide along the surface being cleaned, the soleplate including a suction inlet aperture that defines at least a portion of the suction inlet, the soleplate further including an inner rib, an outer rib, and a channel between the inner rib and the outer rib. The inner rib frictionally engages the first sidewall and the outer rib frictionally engages the second sidewall to create a seal between the soleplate and the housing.

21 Claims, 10 Drawing Sheets

(56) References Cited

U.S. PATENT DOCUMENTS

| | | | | |
|---|---|---|---|---|
| 8,695,161 | B2 | 4/2014 | Williams | |
| 10,076,217 | B2 * | 9/2018 | Conrad | A47L 5/225 |
| 10,470,636 | B2 | 11/2019 | Farmer et al. | |
| 10,512,379 | B2 | 12/2019 | Cho | |
| 10,779,696 | B2 | 9/2020 | Cho | |
| 10,966,587 | B2 | 4/2021 | Farmer et al. | |
| 2005/0050677 | A1 | 3/2005 | Kim | |
| 2007/0266678 | A1 * | 11/2007 | Makarov | A47L 9/1666 55/337 |
| 2010/0257692 | A1 * | 10/2010 | Maguire | A47L 9/0666 15/363 |
| 2011/0107533 | A1 | 5/2011 | Haan | |
| 2014/0259521 | A1 * | 9/2014 | Kowalski | A47L 9/0411 15/383 |
| 2015/0250369 | A1 * | 9/2015 | Krebs | A47L 5/28 15/353 |
| 2019/0200824 | A1 | 7/2019 | Campbell-Hill | |

FOREIGN PATENT DOCUMENTS

| | | | |
|---|---|---|---|
| CN | 204722973 | U | 10/2015 |
| CN | 108937717 | A | 12/2018 |
| CN | 112545377 | A | 3/2021 |
| CN | 212675199 | U | 3/2021 |
| CN | 213345516 | U | 6/2021 |
| KR | 200366787 | Y1 | 11/2004 |
| KR | 200372947 | Y1 | 1/2005 |
| WO | 2017071740 | A1 | 5/2017 |

* cited by examiner

SURFACE CLEANER

This application claims priority to U.S. Provisional Patent Application No. 63/492,419, filed Mar. 27, 2023, the entire contents of which are hereby incorporated by reference herein.

BACKGROUND

The present disclosure relates to surface cleaners and more particularly to the connection between a soleplate of the surface cleaner and a base of the surface cleaner.

SUMMARY

In one embodiment a surface cleaner includes a suction source operable to generate a suction airflow configured to draw debris from a surface to be cleaned, a debris separator in fluid communication with the suction source, the debris separator operable to separate the debris from the suction airflow. The surface cleaner further includes a base including a suction inlet in fluid communication with the debris separator and the suction source such that a suction airflow path extends through the suction inlet, through the debris separator, and through the suction source to transport the suction airflow and the debris from the suction inlet and into the debris separator. The base includes a housing having a channel extending around at least a portion of the suction inlet, the channel having a first sidewall offset from a second sidewall. The base further includes a soleplate configured to slide along the surface being cleaned, the soleplate including a suction inlet aperture that defines at least a portion of the suction inlet, the soleplate further including an inner rib, an outer rib, and a channel between the inner rib and the outer rib. The inner rib frictionally engages the first sidewall and the outer rib frictionally engages the second sidewall to create a seal between the soleplate and the housing.

In another embodiment, a surface cleaner includes a fluid flow path extending from a suction inlet to a clean air outlet, a suction source operable to generate a suction airflow along the fluid flow path configured to draw debris from a surface to be cleaned into the suction inlet, and a debris separator positioned in the fluid flow path operable to separate the debris from the suction airflow. The surface cleaner further includes a nozzle assembly including a housing and a soleplate forming the suction inlet. The nozzle assembly has a joint between the housing and the soleplate, the joint extending around at least a portion of the suction inlet. The joint is formed by a channel in one of the housing and the soleplate extending around at least a portion of the suction inlet, the channel having a first sidewall offset from a second sidewall. The joint is also formed by an inner rib and an outer rib in the other of the housing and the soleplate extending around at least a portion of the suction inlet corresponding to the channel. The inner rib frictionally engages the first sidewall or the outer rib frictionally engages the second sidewall to create a seal between the soleplate and the housing.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

DETAILED DESCRIPTION

Figure 1:
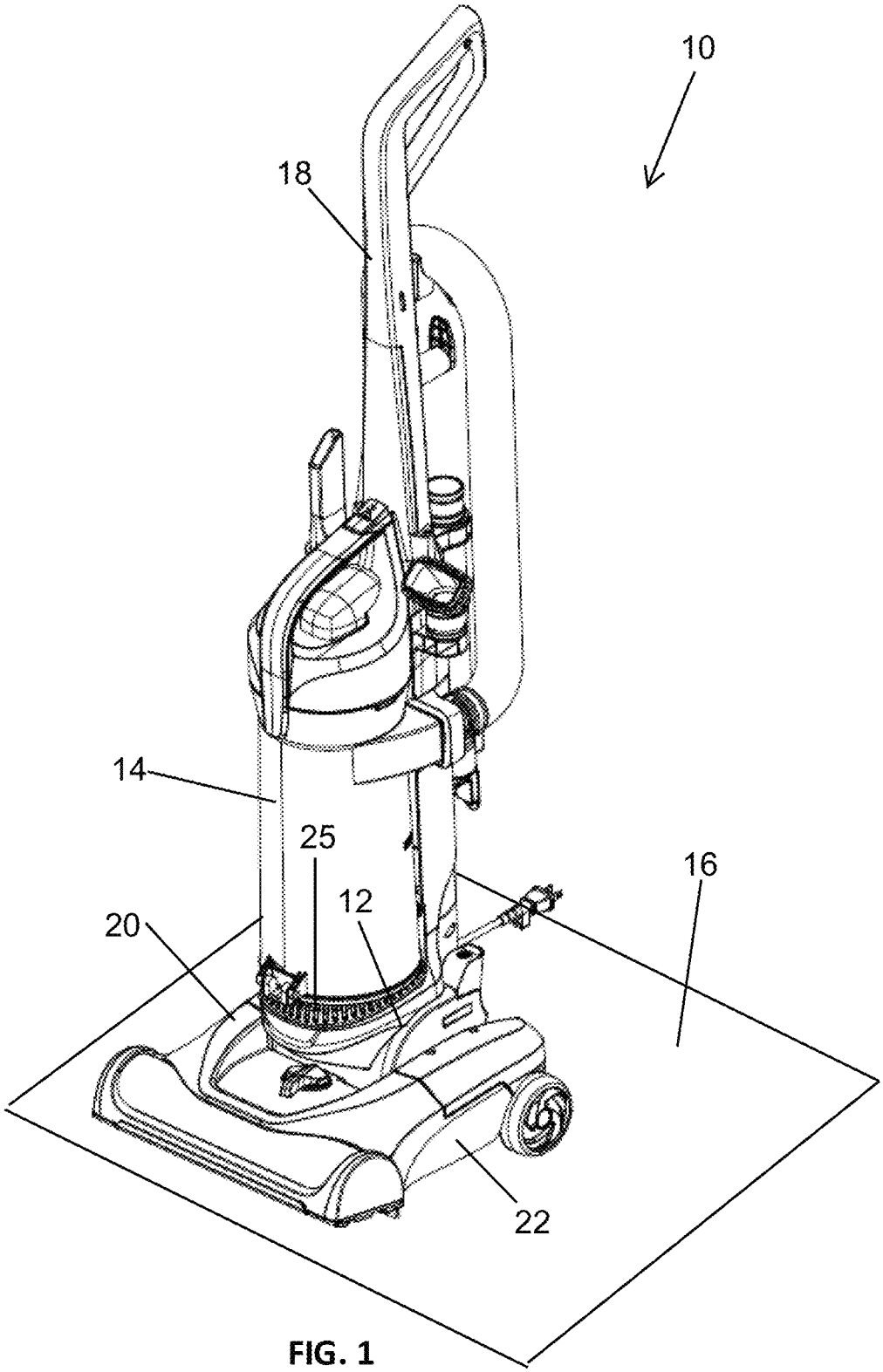
FIG. 1 is a perspective view of a surface cleaner according to one embodiment.
Figure 2:
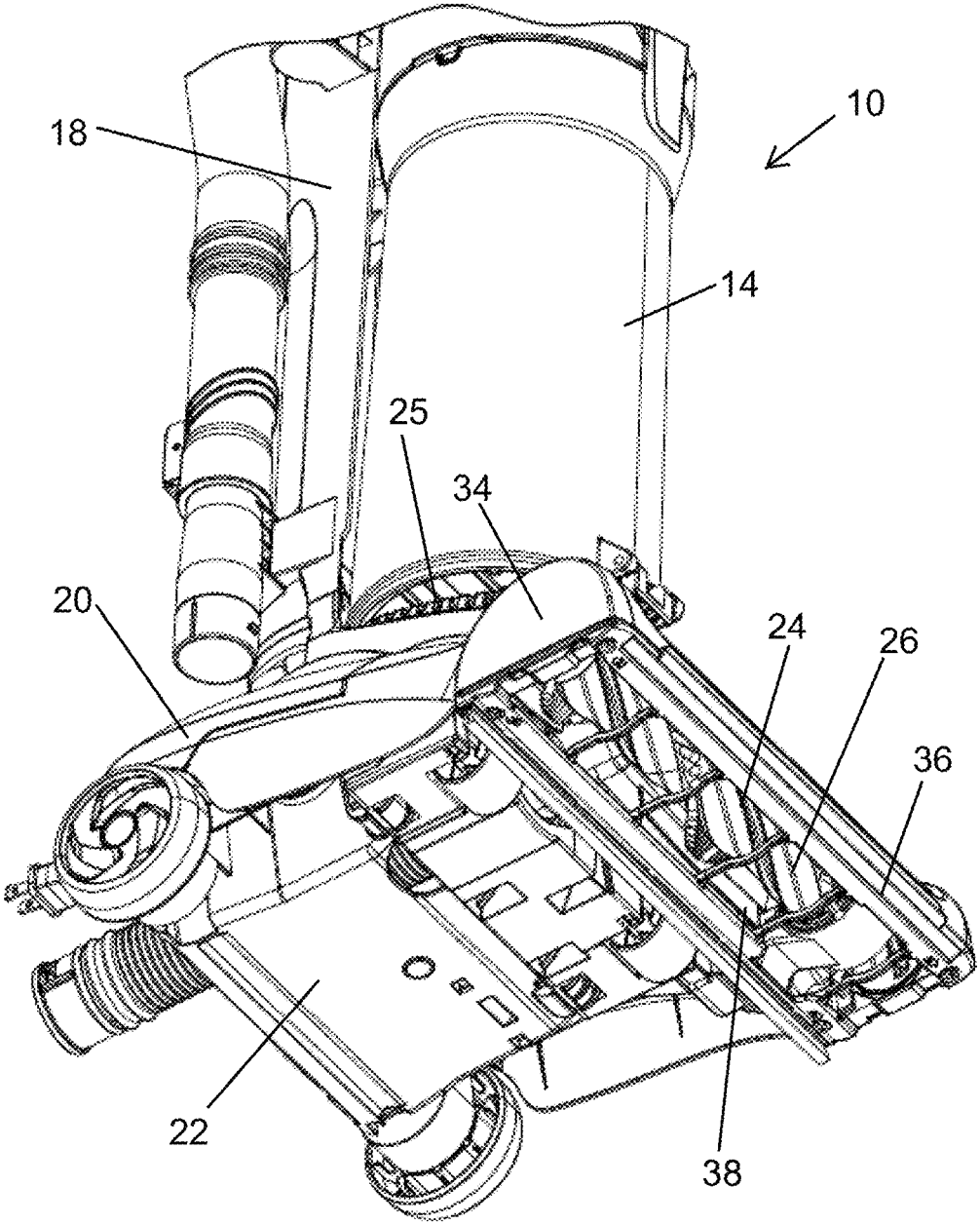
FIG. 2 is an alternative perspective view of a portion of the surface cleaner of FIG. 1.

FIGS. 1 and 2 illustrate a surface cleaner 10. The surface cleaner 10 includes a suction source 12 and a debris separator 14. The suction source 12 includes a motor and a fan and the suction source 12 is operable to generate a suction airflow to draw debris from a surface 16 being cleaned (e.g., floor, upholstery, etc.) and into the debris separator 14. The debris separator 14 separates the debris from the suction airflow and retains the debris in the debris separator 14. In one embodiment, the debris separator 14 includes a cyclonic separator. In some embodiments, the debris separator includes a filter, a filter bag, and/or any other suitable types of debris separators for a surface cleaner. Also, in the illustrated embodiment, the suction source 12 is downstream from the debris separator 14. In other embodiments, the suction source 12 may be upstream or before the debris separator 14 along the suction airflow path.

The surface cleaner 10 includes a handle 18 and a base or nozzle assembly 20. In the illustrated embodiment, the handle 18 is pivotally coupled to the base 20 and the handle 18 is operable to move the base 20 along the surface 16. The debris separator 14 is coupled to the handle 18 for pivotal movement with the handle 18. The handle 18 is pivotal relative to the base 20 between an upright storage position (FIG. 1) and an inclined operating position. In the illustrated embodiment, the surface cleaner 10 is illustrated as a vacuum cleaner, specifically, an upright style vacuum cleaner. In other embodiments, the surface cleaner may be other types of surface cleaners, including utility vacuums, canister vacuums, wet floor cleaners, carpet extractors, robotic vacuum cleaners, and the like.

The base 20 includes a housing 22 and a suction inlet 24. The suction inlet 24 is in fluid communication with the debris separator 14 and the suction source 12. A fluid flow path extends through the suction inlet 24, through the debris separator 14, and through the suction source 12 to transport the suction airflow and the debris from the suction inlet 24 and into the debris separator 14. The fluid flow path further extends through a clean air outlet 25.

Figure 6:
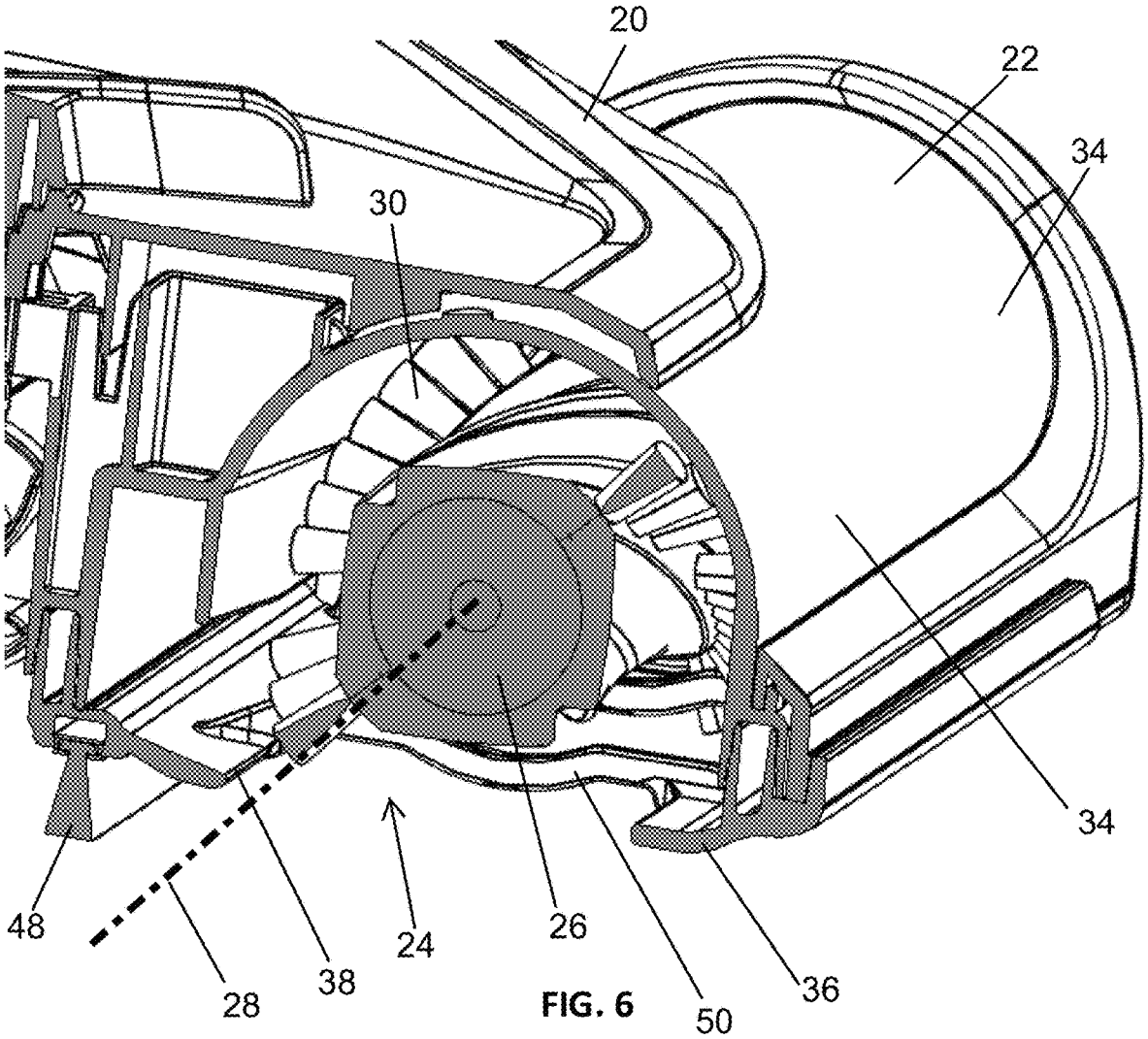
FIG. 6 is a cross-sectional view of a base of the surface cleaner of FIG. 1.
Figure 7:
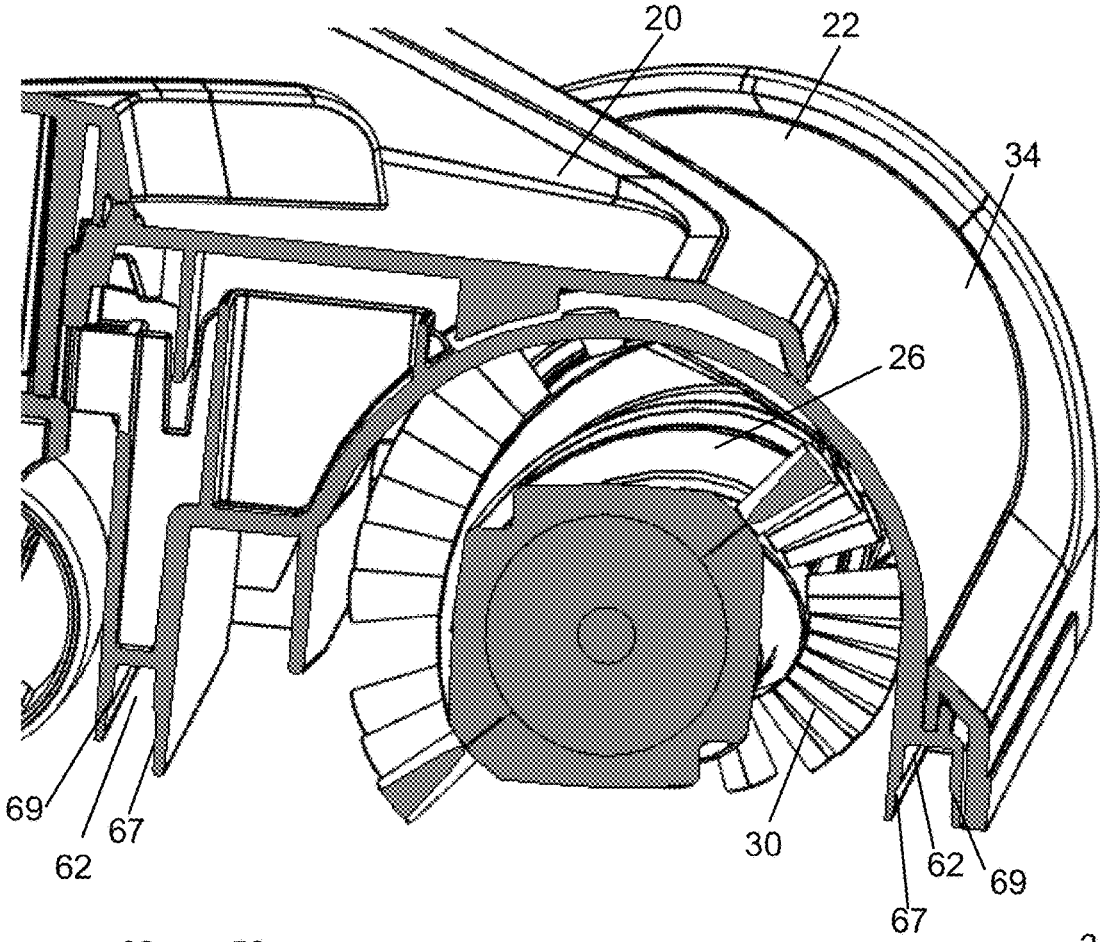
FIG. 7 is a cross-sectional view of the base of the surface cleaner of FIG. 1 with the soleplate removed.

The illustrated base 20 further includes a brushroll 26. The brushroll 26 is rotatable relative to the housing 22 about a brushroll axis 28 (FIG. 6). The brushroll 26 includes bristles 30 that extend through the suction inlet 24 to contact the surface 16. The illustrated surface cleaner 10 includes a belt 32 (FIG. 3) that is operable to rotate the brushroll 26 about the brushroll axis 28. The belt 32 is driven by a motor, which may include the motor of the suction source 12 in some embodiments. The housing 22 extends around a portion of the brushroll axis 28 to define a brushroll housing 34. In some embodiments, the nozzle assembly includes a suction inlet without a brushroll or other rotatable agitator.

Figure 3:
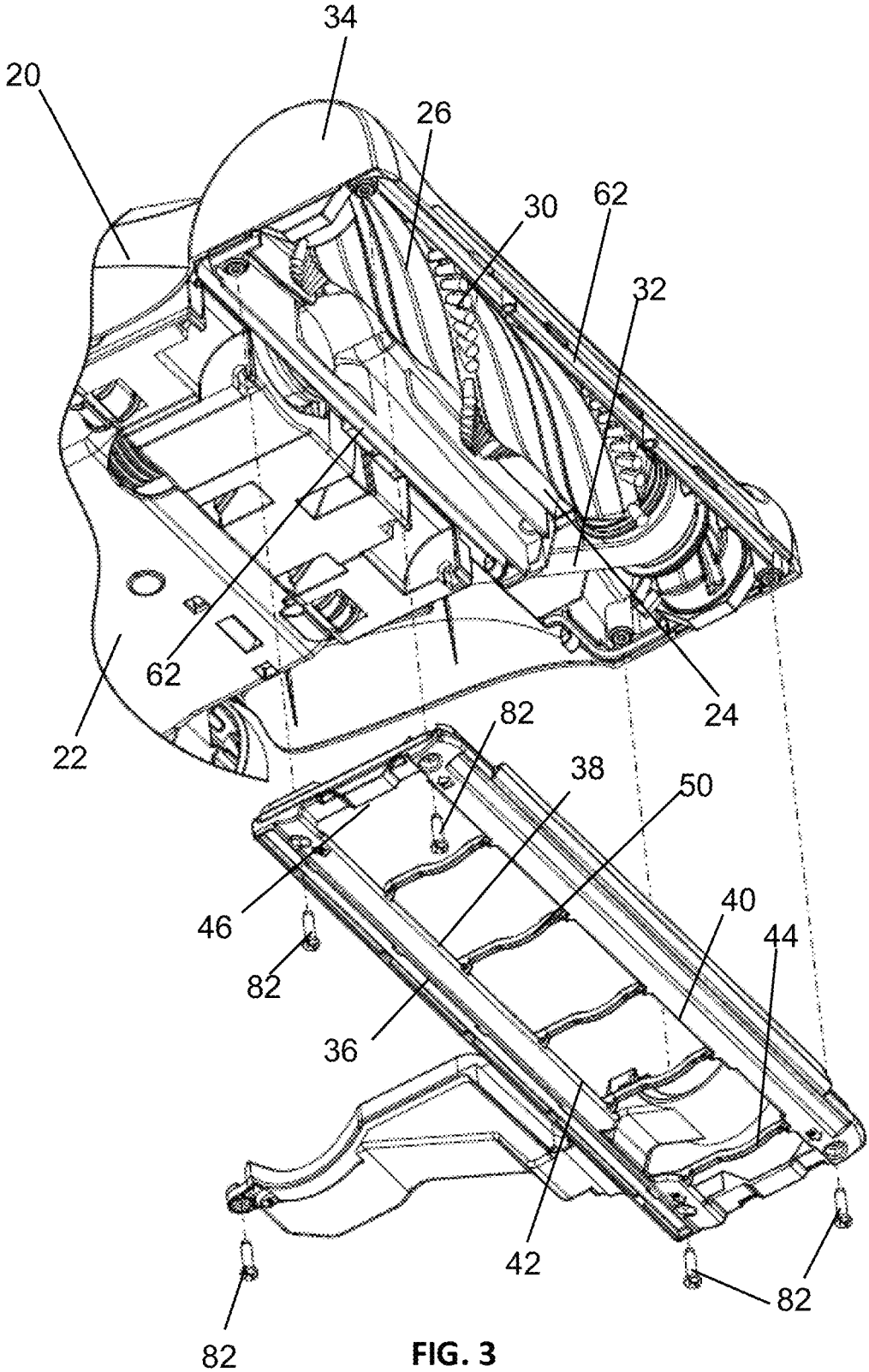
FIG. 3 is an enlarged view of a portion of FIG. 2 with a soleplate of the surface cleaner exploded.
Figure 4:
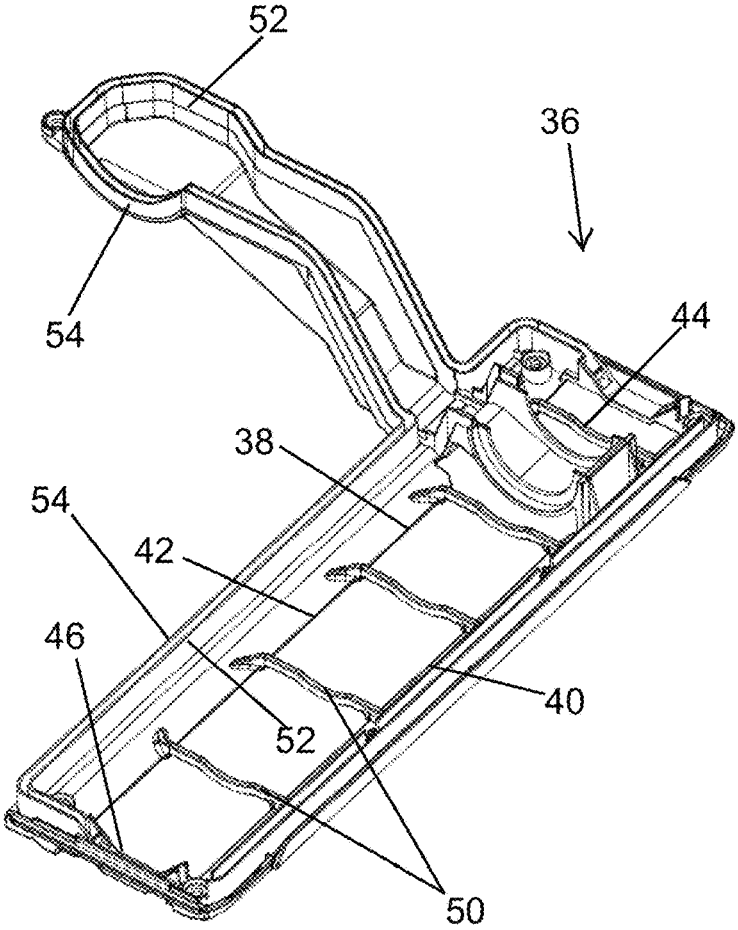
FIG. 4 is a perspective view of the soleplate of the surface cleaner of FIG. 1.

The base 20 further includes a soleplate 36 adjacent the suction inlet 24 and the soleplate 36 slides along or is directly above the surface 16 being cleaned. Referring to FIGS. 3 and 4, the soleplate 36 includes a suction inlet aperture 38 that defines at least a portion of the suction inlet 24. The soleplate 36 includes a front edge 40 and a back edge 42 spaced rearward of the front edge 40. The soleplate 36 further includes a first side edge 44 that extends from the front edge 40 to the back edge 42 and a second side edge 46 that extends from the front edge 40 to the back edge 42. In the illustrated embodiment, the front edge 40 is parallel to the back edge 42 and the first and second side edges 44, 46 are perpendicular to the front and back edges 40, 42. In the illustrated embodiment, the suction inlet aperture 38 is bound by the front edge 40, the back edge 42, the first side edge 44, and the second side edge 46 such that the soleplate 36 extends all the way around the perimeter of the suction inlet 24 and the suction inlet aperture 38 of the soleplate 36 defines the suction inlet 24.

The soleplate 36 may include a brush 48 (FIG. 6) or a wiper or squeegee (not shown) to direct the debris toward the suction inlet 24 as the base 20 moves along the surface 16. Also, the soleplate 36 may include ribs 50 that are disposed below the brushroll 26 and extend across the suction inlet aperture 38 to inhibit ingestion of the power cord or other large objects.

Figure 5:
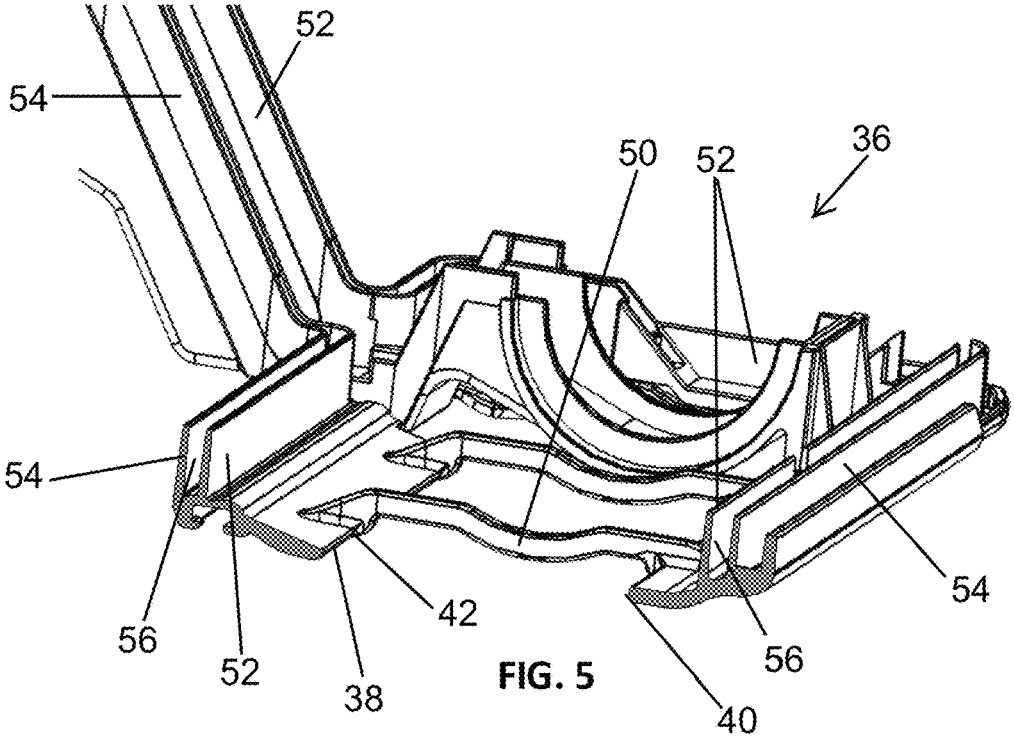
FIG. 5 is a cross-sectional view of the soleplate of FIG. 4.
Figure 10:
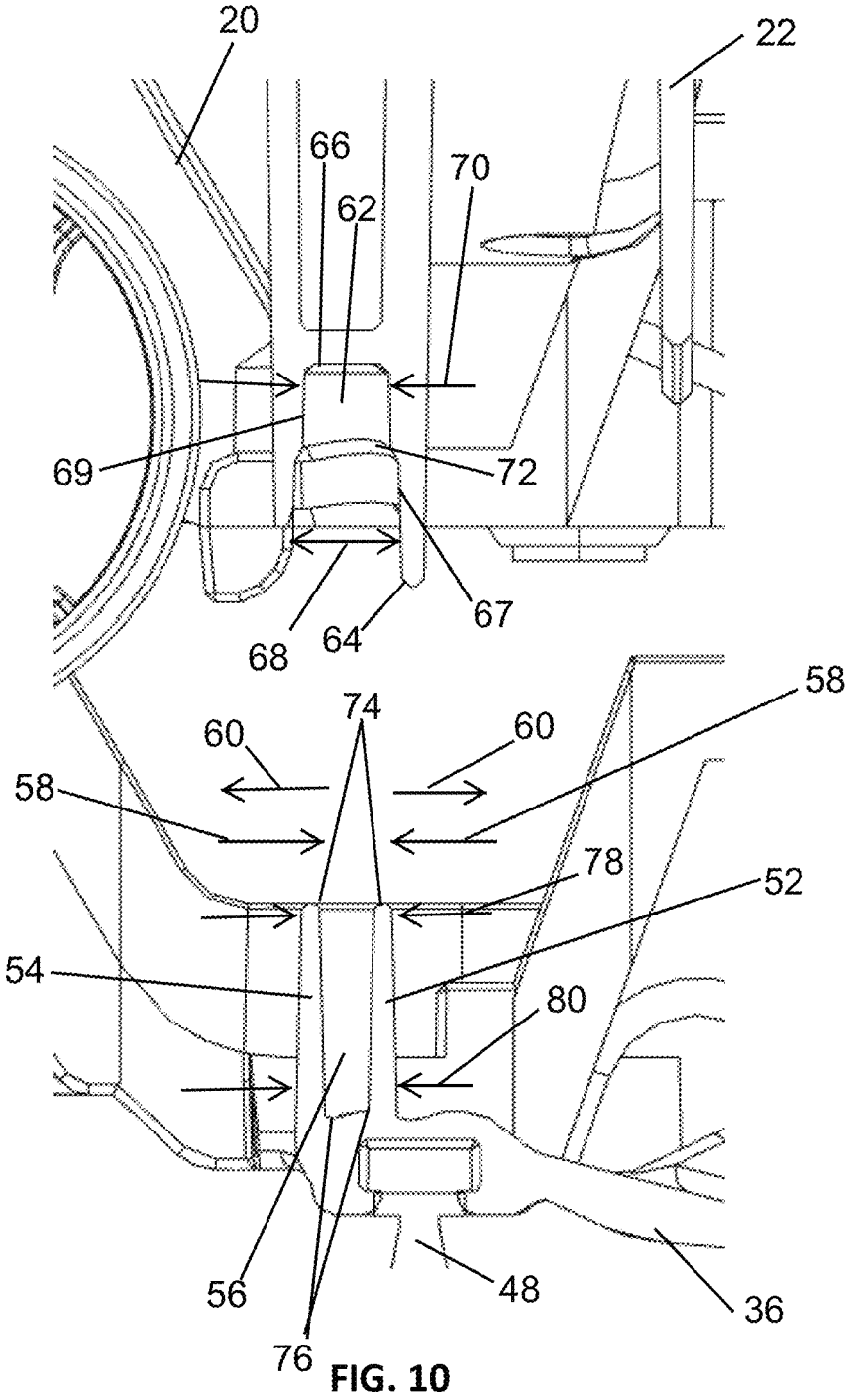
FIG. 10 is a cross-sectional view of the base of the surface cleaner of FIG. 1 showing the soleplate exploded from the base.

Referring to FIGS. 4, 5, and 10, the soleplate 36 further includes an inner rib 52 and an outer rib 54, offset from the inner rib 52, that facilitates coupling the soleplate 36 to the housing 22 and to create a seal between the housing 22 and the soleplate 36. In one embodiment, the inner rib 52 is generally concentric with the outer rib 54. The seal inhibits the suction airflow from traveling through the interface between the soleplate 36 and the housing 22 and bypassing the suction inlet 24. The inner rib 52 is adjacent the suction inlet aperture 38 of the soleplate 36 and extends parallel to the outer rib 54. Longitudinal portions of the inner and outer ribs 52, 54 extend along the brushroll axis 28, parallel to the brushroll axis 28 in the illustrated embodiment. The inner and outer ribs 52, 54 extend upwardly in a direction away from the surface 16. The inner rib 52 and the outer rib 54 extend along the length of the front and back edges 40, 42 that define the suction inlet aperture 38. In the illustrated embodiment, the inner rib 52 and the outer rib 54 extend along the entire length of the front edge 40 and the back edge 42. In other embodiments, the inner and outer ribs 52, 54, may extend only along a portion of the length of the front and back edges 40, 42. The inner rib 52 and the outer rib 54 extend along at least a portion of the first side edge 44 and the second side edge 46 that define the suction inlet aperture 38. In one embodiment, the inner rib 52 and the outer rib 54 extend around a majority of the perimeter of the suction inlet aperture 38 of the soleplate 36.

Figure 9:
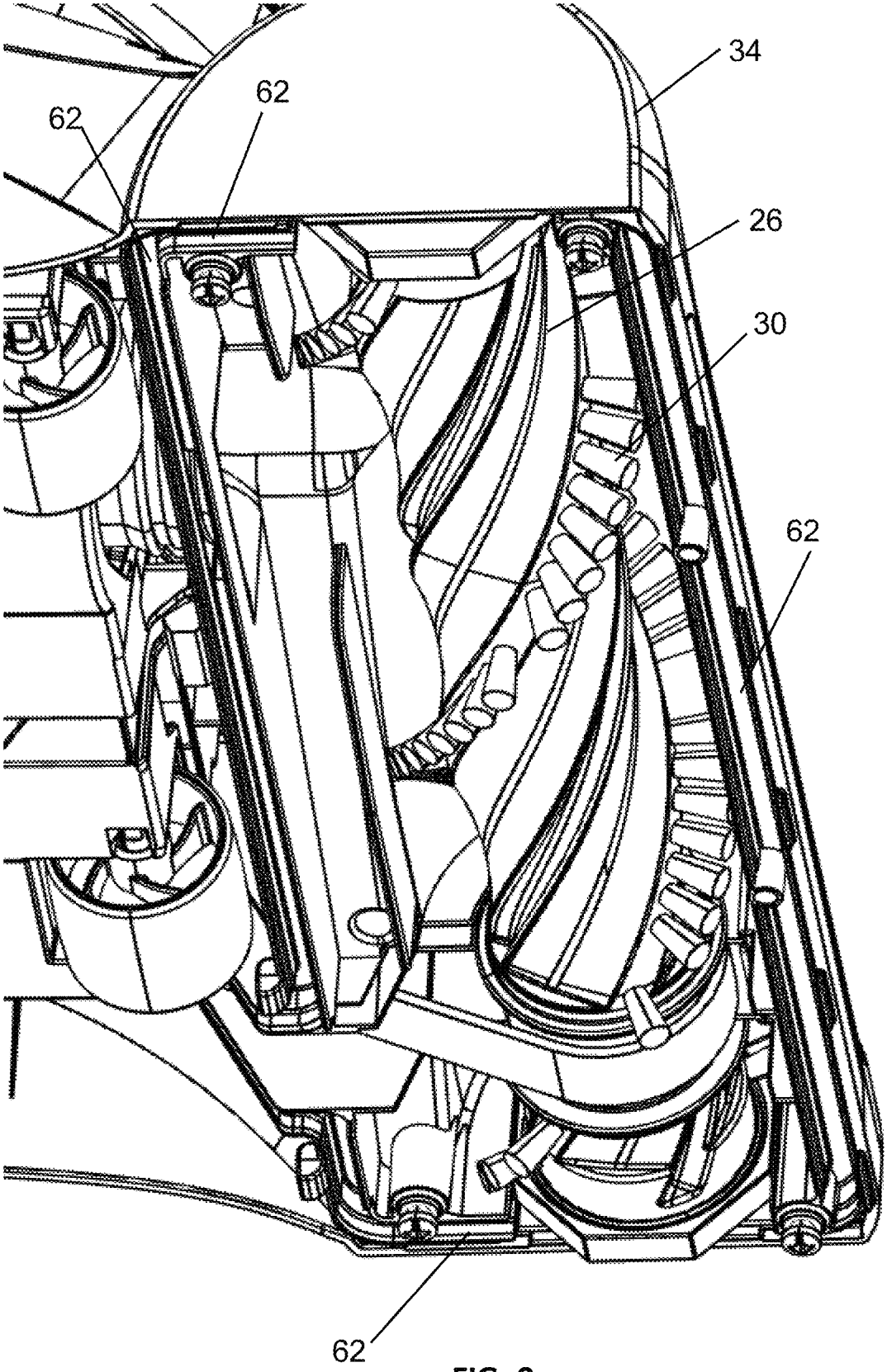
FIG. 9 is an enlarged perspective view of the base of the surface cleaner of FIG. 1 with the soleplate removed.

Referring to FIG. 10, a channel 56 is between the inner rib 52 and the outer rib 54. The channel 56 or space between the inner rib 52 and the outer rib 54 allows the inner and outer ribs 52, 54 to flex and move slightly into the channel 56 in the direction of arrows 58 in FIG. 10. This results in a force in the direction of arrows 60 in FIG. 10 that facilitates coupling the soleplate 36 to the housing 22 and creating the seal between the soleplate 36 and the housing 22. The housing 22 includes a channel 62 that opens downward toward the surface 16. As shown in FIG. 9, the channel 62 extends around the perimeter of the suction inlet 24 at corresponding or adjacent locations to the inner and outer ribs 52, 54 of the soleplate 36 (FIG. 4). For example, the longitudinal length of the ribs 52, 54 corresponds to the length of the channel 62 but the length of the channel 62 and the length of the ribs 52, 54 are not necessarily the same length. Longitudinal portions of the channel 62 extend along the brushroll axis 28, parallel to the brushroll axis 28 in the illustrated embodiment.

Referring to FIG. 10, the channel 62 has an open end 64 and an inside end 66. The channel 62 also includes a first sidewall 67 and a second sidewall 69. The channel 62 has a first width 68, measured between the first sidewall 67 and the second sidewall 69, adjacent the open end 64 and a second width 70, measured between the first sidewall 67 and the second sidewall 69, adjacent the inside end 66. The second width 70 is less than the first width 68 and a transition or taper 72 is located between the first width 68 and the second width 70. The inner and outer ribs 52, 54 have a first end 74 and a second end 76. A first rib width 78 is defined at the first end 74 and a second rib width 80 is defined at the second end 76. The rib widths 78, 80 are the sum of the thicknesses of the ribs 52, 54 and the width of the channel 56. The second rib width 80 is greater than the first rib width 78. A rib height is defined as the distance between the first end 74 and the second end 76. The ribs 52, 54 may have different ribs heights. A channel depth is defined as the distance from the open end 64 of the channel 62 to the inner end 66 of the channel 62. In one embodiment, the height of the ribs 52, 54 is less than the depths of the channel 62. Also, in one embodiment, the amount of flex of the ribs 52, 54, discussed above, at the first end 74 of the ribs 52, 54 is in a range between 0.1% and 2% of the height of the ribs or depth of the channel 62. In other embodiments, the amount of flex of the ribs 52, 54 at the first end 74 of the ribs 52, 54 is in a range between 0.2% and 1.5% of the height of the ribs or depth of the channel 62. In yet other embodiments, the amount of flex of the ribs 52, 54 at the first end 74 of the ribs 52, 54 is in a range between 0.3% and 1% of the height of the ribs or depth of the channel 62. In yet other embodiments, the amount of flex of the ribs 52, 54 could be in other ranges depending on the application.

Figure 8:
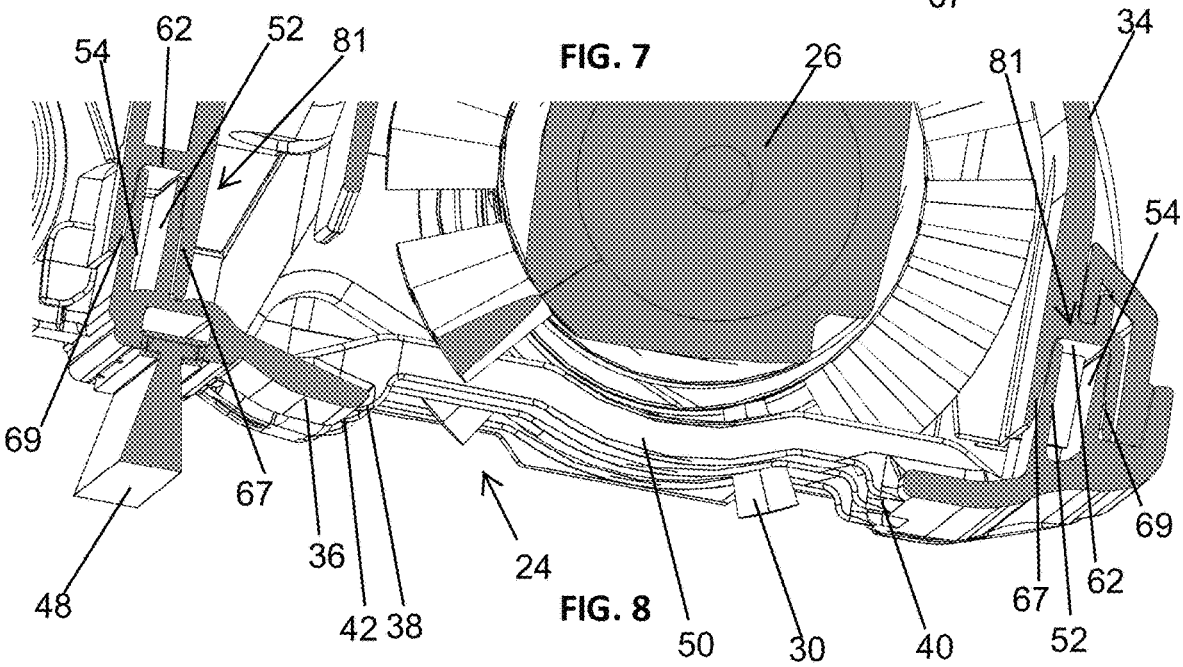
FIG. 8 is an enlarged cross-sectional view of the base of the surface cleaner of FIG. 1.

Referring to FIGS. 8 and 10, a joint 81 is formed between the housing 22 and the soleplate 36, which extends around a majority of a perimeter of the suction inlet 24. In one embodiment, the joint 81 extends around at least 50% of the perimeter of the suction inlet 24. In other embodiments, the joint 81 extends around at least 75% of the perimeter of the suction inlet 24. In yet other embodiments, the joint 81 extends around 90% to 100% of the perimeter of the suction inlet 24. A longitudinal portion of the joint 81 extends along the brushroll axis 26. In the illustrated embodiment, the joint 81 is formed by the inner rib 52 and the outer rib 54 being received in the channel 62 of the housing 22 to couple the soleplate 36 to the housing 22 and to create a seal between the soleplate 36 and the housing 22. It should be understood that the term seal as used herein is not necessarily a perfect air-tight seal but rather that the seal inhibits air from entering the suction airflow through the joint 81 instead of through the suction inlet 24. The inner rib 52 frictionally engages the first sidewall 67 and the outer rib 54 frictionally engages the second sidewall 69 to create a seal between the soleplate 36 and the housing 22. In the illustrated embodiment, there are no gaskets (e.g., rubber gasket) between soleplate 36 and the housing 22. The soleplate 36 directly contacts the housing 22 to create the seal. The width 70 at the inside end 66 of the channel 62 is less than the first rib width 78 to facilitate assembly of the soleplate 36 with the housing 22. During assembly, the inner rib 52 and the outer rib 54 flex into the channel 56 of the soleplate 36 when the inner rib 52 and the outer rib 54 are received in the channel 62 of the housing 22. This flexing forms an interference fit that couples the soleplate 36 to the housing 22 and creates a seal between the soleplate 36 and the housing 22 around the suction inlet 24. Also, the inner rib 52 and the outer rib 54 directly contact the housing 22 inside the channel 62 of the housing 22 to create a friction fit between the soleplate 36 and the housing 22 to couple the soleplate 36 to the housing 22. In one embodiment, the soleplate 36 and the housing 22 are formed from different materials. Referring to FIG. 3, in the illustrated embodiment, threaded fastener 82 are utilized to also secure and couple the soleplate 36 to the housing 22 of the base 20. In the illustrated embodiment, fewer threaded fasteners 82 are employed than was required for certain prior art compression seals because the seal in the joint 81 is formed along the sidewalls 67, 69 with lower reactionary forces in the vertical direction than a compression seal would generate. Also, while the illustrated embodiment has been described with the ribs 52, 54 flexing, in other embodiments, one or both of the sidewalls 67, 69 of the channel 62 may flex to form the interference fit, and/or a combination of one or more ribs 52, 54 flexing with one or more sidewalls 67, 69 flexing. Also, while in the illustrated embodiment, both ribs 52, 54 are described as flexing, in other embodiments, only one of the ribs 52, 54 may flex and/or the ribs 52, 54 may flex at different rates or have different stiffnesses, as well as the sidewalls 67, 69 may flex at different rates or have different stiffnesses.

Figure 11:
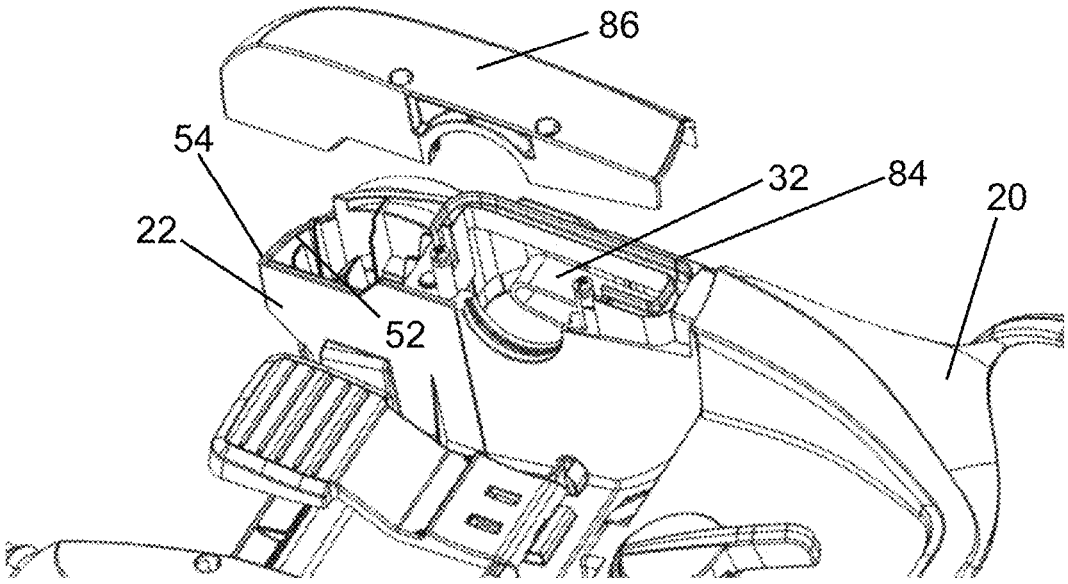
FIG. 11 is a perspective view of a belt housing of the surface cleaner of FIG. 1 showing a belt housing cover removed.
Figure 12:
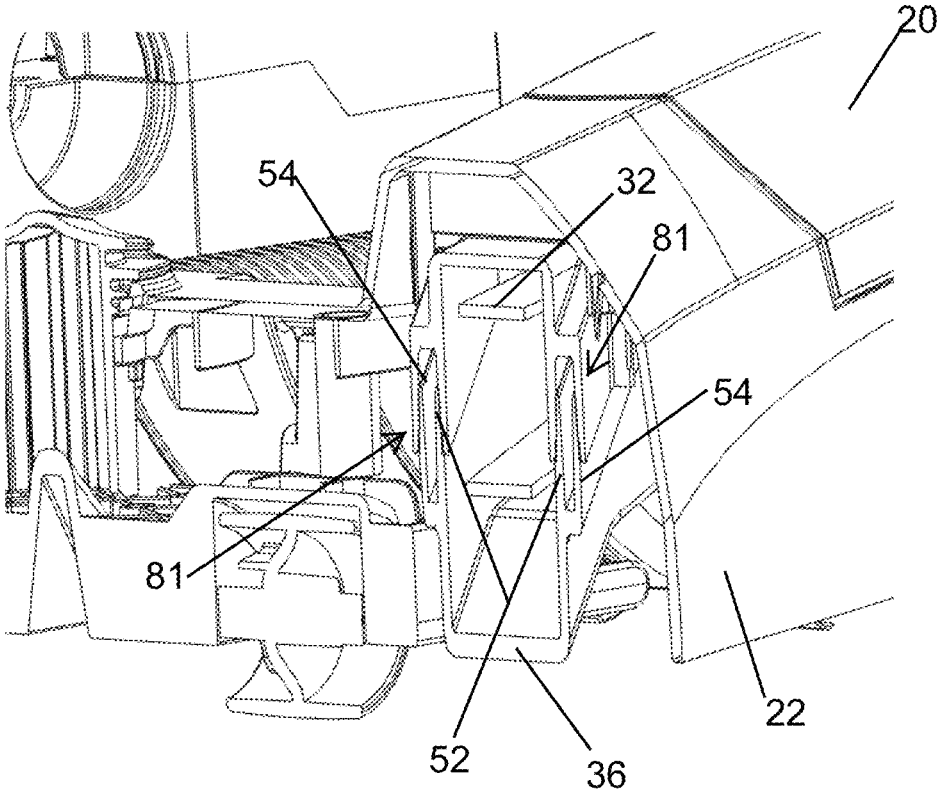
FIG. 12 is a cross-sectional view of the belt housing of the surface cleaner of FIG. 1 with the belt housing cover attached.

Referring to FIGS. 11 and 12, the base 20 includes a belt housing portion 84 through which the belt 32 extends. The belt 32 drives the brushroll 26. The belt housing portion 84 includes a cover 86 that is removable to allow a user to access the belt 32 to replace the belt 32. In the illustrated embodiment, the soleplate 36 forms portions of the belt housing portion 84 along with portions of the housing 22 of the base 20. In other embodiments, the soleplate 36 may not form a portion of the belt housing portion 84 yet the belt housing portion still includes the joint 81. The joint 81 extends around at least a portion of the belt housing portion 84. For example, the inner rib 52 and the outer rib 54 extend around portions of the belt housing portion 84 and are received in channels and described above to create the coupling, seal structure, and friction fit discussed above.

In the illustrated embodiment of FIGS. 1-12, the joint 81 has been illustrated with the soleplate 36 including the inner rib 52 and the outer rib 54 and the housing 22 of the base 20 including the channel 62 in which the ribs 52, 54 are received. In other embodiments, the housing 22 of the base 20 may include the inner rib 52 and the outer rib 54 and the soleplate 36 includes the channel 62 in which the ribs 52, 54 are received.

Figure 13:
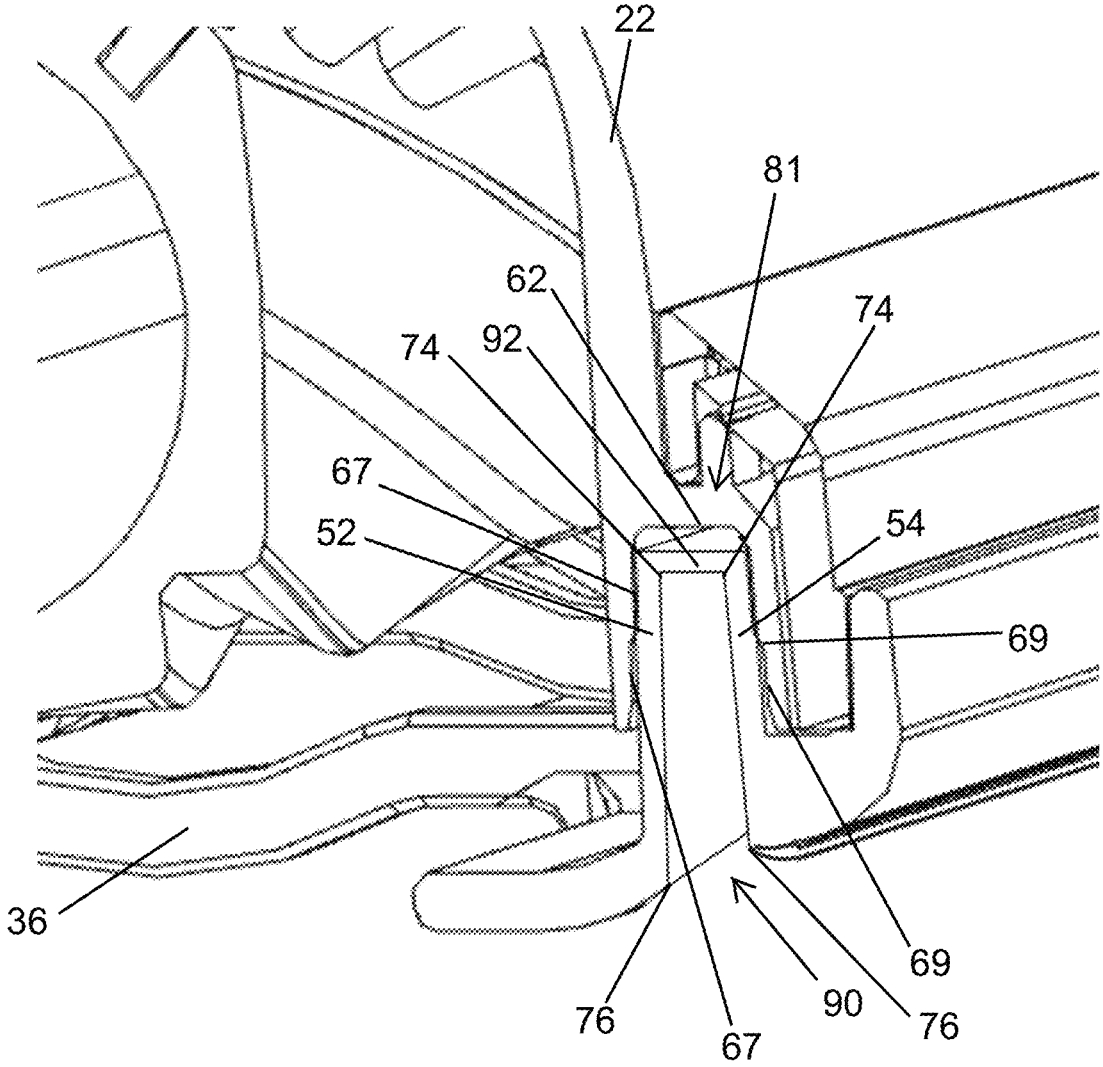
FIG. 13 is a cross-sectional view of a base of a surface cleaner according to another embodiment.

Also, FIG. 13 illustrates an alternative embodiment of the joint 81 described above. The joint 81 of FIG. 13 includes features similar to the joint 81 of FIGS. 1-12 and only some differences will be discussed below and like components have been given the same reference number. In the embodiment of FIG. 13, there is an opening 90 adjacent the second ends 76 of the ribs 52, 54. And, there is a wall 92 that extends between the first ends 74 of the ribs 52, 54. When the ribs 52, 54 are received in the channel 62, the sidewalls 67, 69 flex and/or the ribs 52, 54 flex adjacent the opening 90 to facilitate the friction fit and seal between the ribs 52, 54 and the sidewalls 67, 69 of the channel 62.

Certain interference seals in the prior art, such as U.S. Pat. Nos. 6,101,669 and 8,695,161, are configured to press one rib into one corresponding channel. The prior art interference seals created manufacturing challenges for product designs that desired such a seal between large parts, or to surround a large area. Variations in shrinkage between parts during plastic molding could cause misalignments of the single rib and the corresponding channel, resulting in difficulty in assembly, improper part fit, and possibly reduced effectiveness in sealing. The need to match the single rib to its corresponding channel required more attention to molding processes and inspection, and could cause higher scrap rates of improperly fitting parts or require use of higher priced plastics with lower, more predictable shrink rates. The presently disclosed joint 81 accommodates more variation in shrinkage between parts, larger tolerances in part sizing, and accommodates misalignments by providing the channel 56 between the ribs 52, 54 to enable the ribs to flex in the channel 62 during assembly while maintaining a seal along at least one of the sidewalls 67, 69. The presently disclosed joint 81 enables lower priced resins with higher shrink rates to be molded, for example, polyolefins, while maintaining assembly of the joint 81 at a lower cost.

Various features and advantages of the disclosure are set forth in the following claims.

What is claimed is:

1. A surface cleaner comprising:

a suction source operable to generate a suction airflow configured to draw debris from a surface to be cleaned;

a debris separator in fluid communication with the suction source, the debris separator operable to separate the debris from the suction airflow; and a base including a suction inlet in fluid communication with the debris separator and the suction source such that a suction airflow path extends through the suction inlet, through the debris separator, and through the suction source to transport the suction airflow and the debris from the suction inlet and into the debris separator, the base further including, a housing having a channel extending around at least a portion of the suction inlet, the channel having a first sidewall offset from a second sidewall, and a soleplate configured to slide along the surface being cleaned, the soleplate including a suction inlet aperture that defines at least a portion of the suction inlet, the soleplate further including an inner rib, an outer rib, and a channel between the inner rib and the outer rib, wherein the inner rib frictionally engages the first sidewall and the outer rib frictionally engages the second sidewall to create a seal between the soleplate and the housing.

2. The surface cleaner of claim 1, wherein the inner rib and the outer rib extend around a majority of a perimeter of the suction inlet aperture.

3. The surface cleaner of claim 1, wherein the outer rib is offset from the inner rib.

4. The surface cleaner of claim 1, wherein the base includes a brushroll that is rotatable relative to the housing about a brushroll axis, wherein a longitudinal portion of the channel of the housing extends along the brushroll axis, and wherein a longitudinal portion of the inner rib and the outer rib extend along the brushroll axis corresponding to the channel of the housing.

5. The surface cleaner of claim 4, wherein the base includes a belt operable to rotate the brushroll about the brushroll axis, wherein the soleplate includes a belt housing portion, the belt extending through the belt housing portion, and wherein the inner rib and the outer rib extend around at least a portion of the belt housing portion.

6. The surface cleaner of claim 4, wherein the housing of the base extends around a portion of the brushroll axis to define a brushroll housing.

7. The surface cleaner of claim 1, wherein the inner rib is adjacent the suction inlet aperture of the soleplate.

8. The surface cleaner of claim 1, wherein at least one of the inner rib and the outer rib flexes when the inner rib and the outer rib are received in the channel thereby forming an interference fit.

9. The surface cleaner of claim 1, wherein the channel of the housing opens downwardly toward the surface and the first rib and the second rib extend upwardly in a direction away from the surface.

10. The surface cleaner of claim 1, wherein the suction inlet aperture extends around a perimeter of the suction inlet.

11. The surface cleaner of claim 1, wherein the channel has an open end configured to receive the inner rib and outer rib and an inside end, wherein a first width between the first sidewall and the second sidewall at the open end is greater than a second width between the first sidewall and the second sidewall at the inside end.

12. The surface cleaner of claim 1, wherein the soleplate includes a front edge, a back edge spaced rearward of the front edge, a first side edge extending between the front edge and back edge and a second side edge opposite the first side edge extending between the front edge and back edge, wherein the suction inlet aperture extends along the front edge.

13. A surface cleaner comprising:

a fluid flow path extending from a suction inlet to a clean air outlet;

a suction source operable to generate a suction airflow along the fluid flow path configured to draw debris from a surface to be cleaned into the suction inlet;

a debris separator positioned in the fluid flow path operable to separate the debris from the suction airflow; and a nozzle assembly including a housing and a soleplate forming the suction inlet;

the nozzle assembly having a joint between the housing and the soleplate, the joint extending around at least a portion of the suction inlet;

the joint being formed by:

a channel in one of the housing and the soleplate extending around at least a portion of the suction inlet, the channel having a first sidewall offset from a second sidewall; and an inner rib and an outer rib in the other of the housing and the soleplate extending around at least a portion of the suction inlet corresponding to the channel;

wherein the inner rib frictionally engages the first sidewall or the outer rib frictionally engages the second sidewall to create a seal between the soleplate and the housing.

14. The surface cleaner of claim 13, wherein the joint extends around a majority of a perimeter of the suction inlet.

15. The surface cleaner of claim 13, wherein the inner rib frictionally engages the first sidewall and the outer rib frictionally engages the second sidewall.

16. The surface cleaner of claim 13, wherein the nozzle assembly includes a brushroll that is rotatable relative to the housing about a brushroll axis, wherein a longitudinal portion of the joint extends along the brushroll axis.

17. The surface cleaner of claim 13, wherein the nozzle assembly includes a belt operable to rotate the brushroll about the brushroll axis, wherein the nozzle assembly includes a belt housing portion, the belt extending through the belt housing portion, and wherein the joint extends around at least a portion of the belt housing portion.

18. The surface cleaner of claim 17, wherein the housing extends around a portion of the brushroll axis to define a brushroll housing.

19. The surface cleaner of claim 13, wherein at least one of the inner rib and the outer rib flexes when the inner rib and the outer rib are received in the channel thereby forming an interference fit.

20. The surface cleaner of claim 13, wherein the channel is provided in the housing opening downwardly toward the surface, and the first rib and the second rib are provided in the soleplate extending upwardly in a direction away from the surface.

21. The surface cleaner of claim 13, wherein the channel has an open end and an inside end, the open end configured to receive the inner rib and the outer rib, wherein a first width between the first sidewall and the second sidewall at the open end is greater than a second width between the first sidewall and the second sidewall at the inside end.

* * * * *